US005383663A

United States Patent [19]

Anghelo et al.

[11] Patent Number: 5,383,663

[45] Date of Patent: Jan. 24, 1995

[54] PLAYER CONTROLLED DUMP RAMP FOR A PINBALL GAME

[75] Inventors: Python V. Anghelo, Chicago; Raymond J. Czajka, Hometown, both of Ill.

[73] Assignee: Williams Electronics Games, Inc., Chicago, Ill.

[21] Appl. No.: 141,256

[22] Filed: Oct. 22, 1993

[51] Int. Cl.[6] ..... A63E 7/02; A63E 7/30

[52] U.S. Cl. ..... 273/118 R; 273/118 A; 273/119 A; 273/121 A; 273/121 E

[58] Field of Search ..... 273/118-121, 273/128, 109, 127 R

[56] References Cited

U.S. PATENT DOCUMENTS

| | | | |
|---|---|---|---|
| 2,127,261 | 8/1938 | Kramer et al. | 273/118 A X |
| 4,840,375 | 6/1989 | Lawlor et al. | 273/121 E X |
| 4,981,298 | 1/1991 | Lawlor et al. | 273/121 A |
| 5,002,279 | 3/1991 | Kaminkow et al. | 273/119 A |

FOREIGN PATENT DOCUMENTS

| | | | |
|---|---|---|---|
| 78914 | 5/1983 | European Pat. Off. | 273/119 R |

*Primary Examiner*—Mark S. Graham
*Assistant Examiner*—Raleigh W. Chiu
*Attorney, Agent, or Firm*—Rockey, Rifkin and Ryther

[57] ABSTRACT

The play feature consists of a first surface and second surface for supporting a rolling ball therebetween. The surfaces are made movable relative to one another such that in a first position they support a ball therebetween and in a second position they are spaced far enough apart to allow a ball to fall therebetween. The surfaces are movable relative to one another by a solenoid or other similar driver where the solenoid is controlled by a player operated button. As a ball rides along the first and second surfaces, the player operates the solenoid to move the first and second surfaces apart allowing the ball to fall between the surfaces at a desired location. A plurality of targets, ramps or the like can be provided below the surfaces as target objectives for the player.

15 Claims, 3 Drawing Sheets

PLAYER CONTROLLED DUMP RAMP FOR A PINBALL GAME

BACKGROUND OF THE INVENTION

The invention relates, generally, to pinball games and, more particularly, to an improved play feature for such games.

Pinball games, as will be appreciated, typically consist of an inclined playfield supporting a plurality of playfield features such as targets, ramps, skill shots, bumpers and the like, a rolling ball and player controlled flippers. The player operates the flippers to propel the ball at selected play features to score points and control the play of the game.

The success of a manufacturer's line of pinball games depends, in part, on its ability to create new and exciting playfield features to attract players to its games. It will be apparent that novel play features must continuously be developed which challenge the player and are fun to play. In addition to the standard flippers, many games include other player controlled play features, so called "skill shots", that require player involvement, such as pressing a button, to complete the shot. Such a skill shot is disclosed in U.S. Pat. No. 5,186,462 issued to Biagi et al. which discloses a ball projecting mechanism that is fired at a selected target by the player pressing a button. U.S. Pat. No. 4,981,298 issued to Lawlor et al. discloses a ball diverter for a pinball game. A novel, player controlled skill shot for a pinball game is desired.

SUMMARY OF THE INVENTION

The play feature of the invention consists of a first surface and a second surface for supporting a rolling ball therebetween. One of the surfaces is movable relative to the other such that in a first position they support the rolling ball and in a second position they are spaced far enough apart to allow a ball to fall therebetween. The surface is moved by a solenoid or other similar driver where the solenoid may be controlled by a player operated button. As a ball rides along the first and second surfaces, the player and/or the game computer operates the solenoid to move the surfaces apart allowing the ball to fall between the surfaces at a desired location. A plurality of targets, ramps or the like can be provided below the first and second surfaces as target objectives for the player.

DETAILED DESCRIPTION OF THE INVENTION

Figure 1:
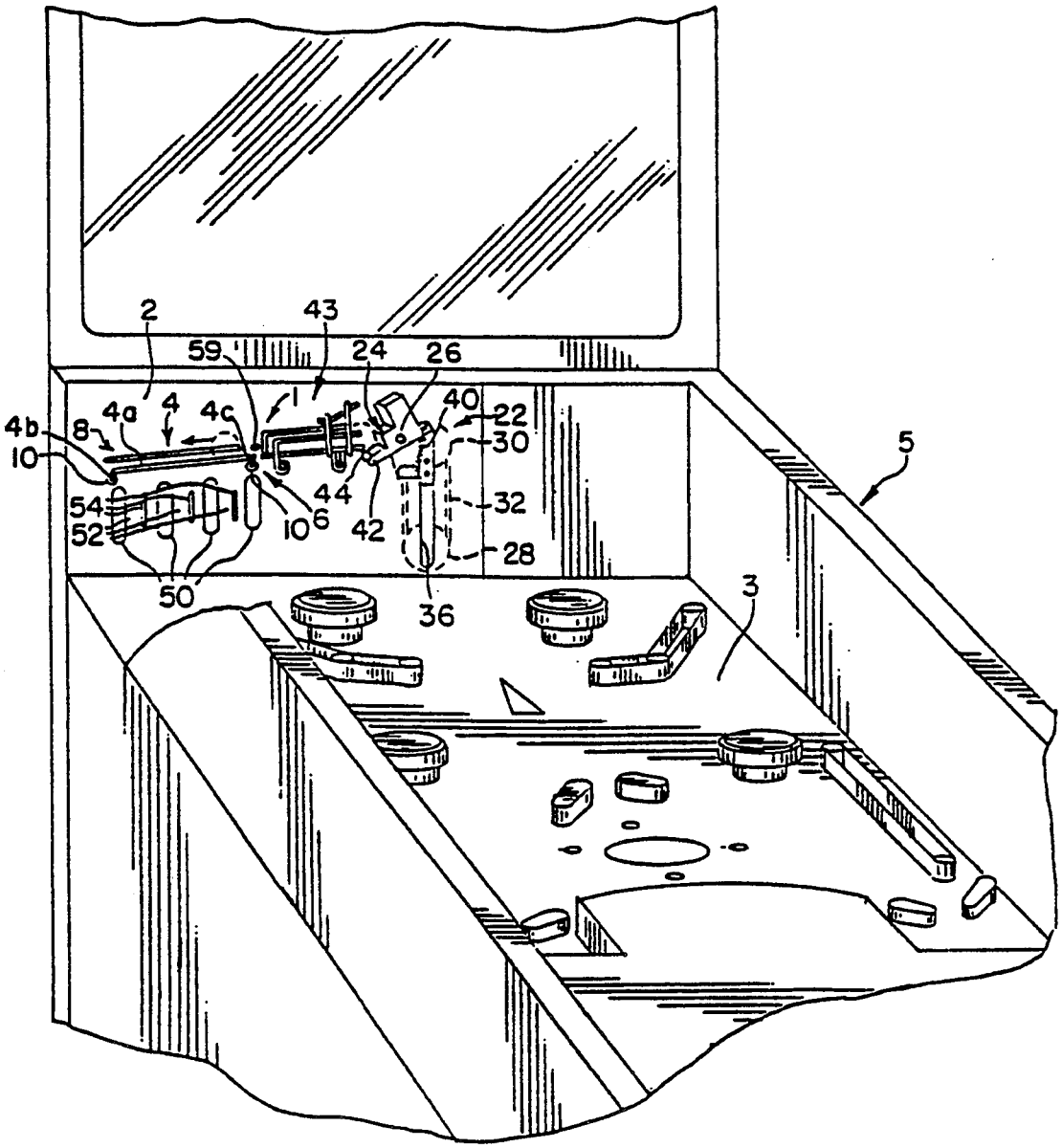
FIG. 1 is a perspective view of a pinball game with the play feature of the invention.
Figure 2:
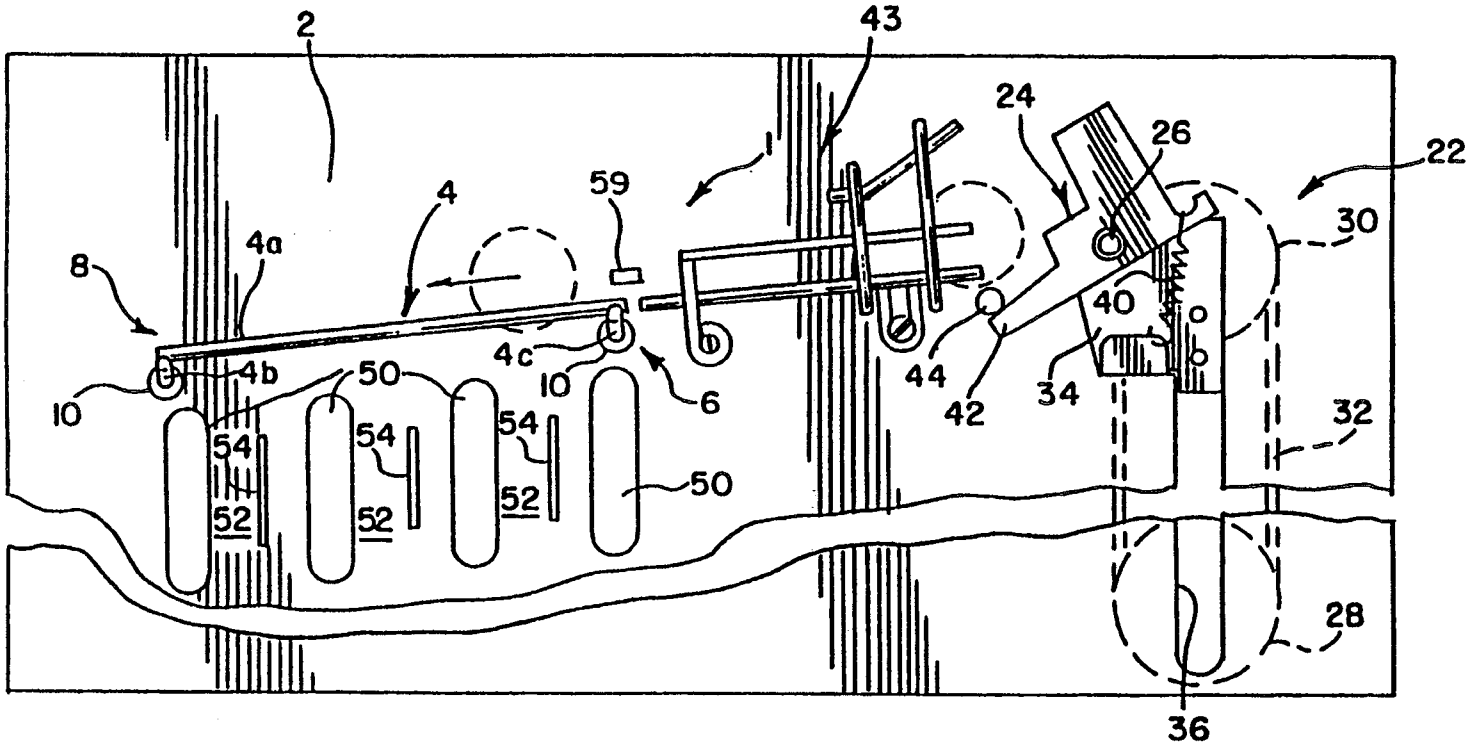
FIG. 2 is a front elevational view of the play feature of the invention.
Figure 3:
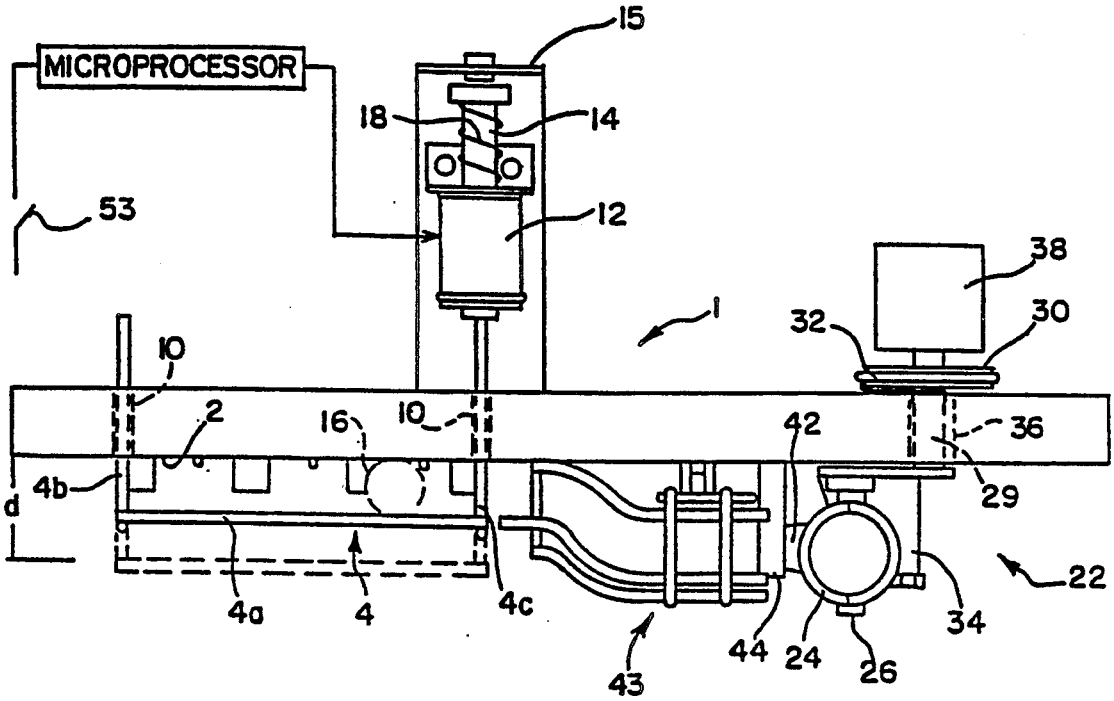
FIG. 3 is a plan view of the play feature of the invention.

Referring more particularly to FIGS. 1 through 3, the play feature of the invention is shown generally at 1 consisting of a first surface 2 and a second surface 4. As illustrated, the first surface 2 consists of a vertically extending wall which can be located anywhere on or above the playfield 3 of pinball game 5. Preferably it forms a back vertically disposed wall of the playfield 3. The second surface 4 consists of a wire rail mounted at an incline such that the first or ball receiving end 6 is disposed higher than the second end 8.

Wire rail 4 includes a first section 4*a* extending parallel to wall 2 and a pair of extensions 4*b* and 4*c* extending from section 4*a* substantially perpendicular to wall 2. Extensions 4*b* and 4*c* extend through apertures 10 formed on wall 2 such that rail 4 can be moved relative to wall 2 by sliding extensions 4*b* and 4*c* in apertures 10. A bushing (not shown), can be located in each of apertures 10, if desired.

A solenoid 12 is mounted to the side of wall 2 opposite rail 4 as, for example, with an L-bracket. Solenoid 12 includes a reciprocating plunger 14 that is connected to extension 4*c*. When solenoid 12 is actuated, plunger 14 will be operated to move the rail 4 from the first position shown in solid line to the second position shown in dashed line in FIG. 2. Plunger 14 moves a distance sufficient to create a space d between rail 4 and wall 2 greater than the diameter of the ball 16. A compression spring 18, mounted coaxially with plunger 14 between support bracket 15 and solenoid 12, returns the plunger to its retracted position (and rail 4 to its solid line position) when the solenoid is deactivated.

Any suitable device can be used to deliver a ball to the ball receiving end 6 of rail 4. In the illustrated embodiment, elevator 22 is used consisting of a ball receiving cup 24 pivotably mounted to a support 34 at pin 26. To raise and lower cup 24 a pair of pulleys 28 and 30 are pivotably mounted to wall 2 and supporting a flexible transmission member 32 therebetween. A pin 29 is fixed to the transmission member 32 such that it extends through slot 36 in wall 2 and carries support 34. A reversible rotating motor 38 drives pulley 28 to reciprocate transmission member 32 thereby to raise and lower cup 24.

Cup 24 is provided with a cam finger 42 that engages cam pin 44 mounted to wall 2 as the cup is raised as shown in FIG. 1. When finger 42 contacts pin 44, the cup 24 will be pivoted counter clockwise to the position shown in FIG. 1 to dump the ball into wire form guide 43. A spring 40 returns cup 24 to its ball receiving position once cup 24 is lowered by elevator 22 and finger 42 is disengaged from pin 44. Wire form guide 43 delivers the ball from cup 24 to the rail 4 by force of gravity.

While a specific ball delivery device has been described, it will be appreciated that any suitable mechanism can be used to deliver the ball to rail 4. For example, a simple molded plastic or wire form ramp can be used, as can other delivery mechanisms including magnetic ball lifters such as shown in U.S. Pat. No. 4,848,748 issued to Krutsch.

Located below and spaced along the length of rail 4 are a plurality of player objectives such as targets, ramps or the like. In the preferred embodiment, a plurality of bumpers 50 are mounted to wall 2 to define lanes 52 therebetween. Located in each lane 52 is a roll over switch 54 or other mechanism for sensing the presence of a passing ball and delivering a signal to the game microprocessor.

In operation, the ball accesses rail 4 via any suitable mechanism, such as elevator 22 or a ramp or magnetic lifting device. When the ball is deposited on ball receiving end 6 of rail 4 it will roll from end 6 toward end 8 by force of gravity because of the inclination of rail 4. Specifically, the ball 16 will contact rail 4 and wall 2 as shown in the figures such that it is suspended between these two surfaces as it rolls along the rail.

The player, by depressing a player controlled button associated with switch 53, delivers a signal to the game microprocessor which actuates solenoid 12 so as to move rail 4 away from wall 2 at any time while the ball traverses the rail. A fail safe sensor 59 can be located at end 6 of rail 4 to detect the presence of a ball and to deliver a signal to the game microprocessor enabling actuation of solenoid 12 if the game player does not. By properly manipulating the button associated with switch 53, the player can control the location at which the ball is dropped and, therefore, try to select a particular one of targets 54 or other player objective to be contacted by the ball.

It is contemplated, that of the several targets, ramps or other play objectives provided below rail 4, selected ones will be more or less desirable to be contacted by the ball, as determined by the game rules. Thus, by properly manipulating the player switch 53, the player can "hit" a desired target. It will be appreciated that the ball does not have to physically contact the play objectives, for example, optical switches can be used to sense the presence of the ball.

Figure 4:
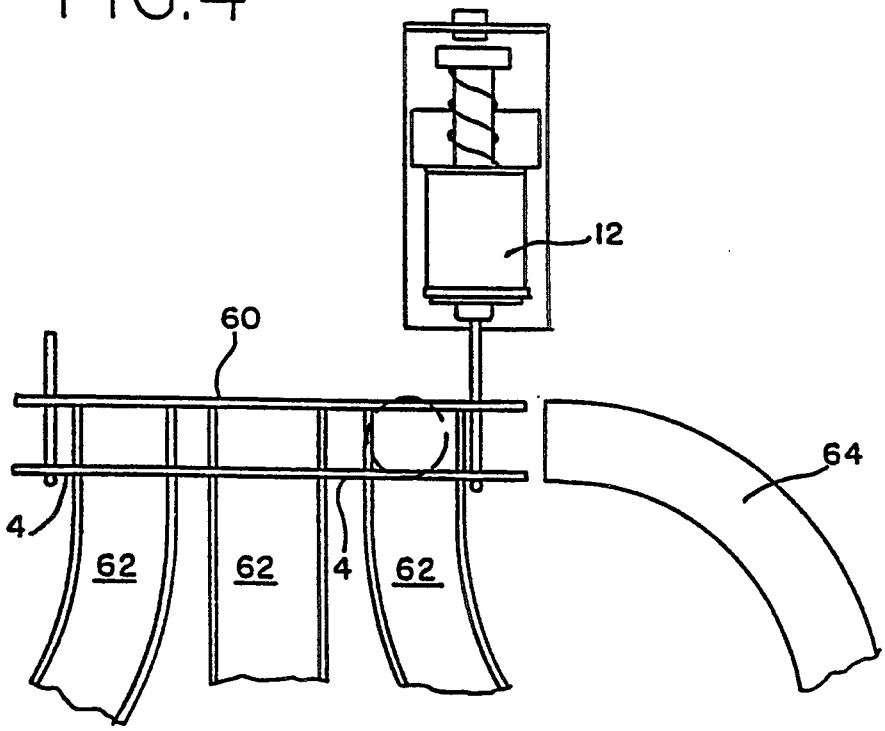
FIG. 4 is an alternate embodiment of the play feature of the invention.

An alternate embodiment of the invention is shown in FIG. 4, where the wall 2 is replaced by a second rail 60. Rail 4 will be moved by solenoid 12 in a manner similar to that of the embodiment of FIGS. 1 and 2. A ramp 64 is provided to deliver the ball 65 to the rails 4 and 60. The rails 4 and 60 can be disposed over ramps 62 or other playfield features or targets. In an alternate configuration, both rails 4 and 60 could be made movable if desired.

While the invention has been described in some detail with reference to the figures, it will be appreciated that numerous changes in the details and construction of the device can be made without departing from the spirit and scope of the invention.

What is claimed is:

1. A pinball game having a playfield on which a ball rolls, comprising:

a) first and second ball supporting surfaces disposed above the playfield adapted to support the ball therebetween as it rolls along said first and second surfaces, said first surface being a vertical wall extending upwardly from the playfield;

b) means for delivering a ball to said first and second surfaces;

c) a plurality of play objectives located below said first and second surfaces and spaced along the length thereof; and d) player controlled means for moving one of said first and second surfaces relative to the other to allow the ball to drop between said surfaces toward the playfield to obtain and operate one of said play objectives.

2. The pinball game according to claim 1, wherein said second surface is a rail.

3. The pinball game according to claim 1, wherein said first and second surfaces are rails.

4. The pinball game according to claim 1, wherein said pinball game includes targets mounted on said wall.

5. The pinball game according to claim 1, wherein said means for delivering includes a ramp.

6. The pinball game according to claim 1 wherein said means for delivering includes a ball elevating mechanism.

7. The pinball game according to claim 1, wherein said play objectives include a plurality of ramps.

8. The pinball game according to claim 1, wherein said play objectives include a plurality of ball lanes.

9. The pinball game according to claim 1, wherein said player controlled means includes a solenoid operatively connected to one of said surfaces.

10. The pinball game according to claim 1, wherein said first surface is a vertical wall, said second surface is a rail movable relative to said wall and said player controlled means includes a solenoid mounted to the wall and operatively connected to said rail.

11. A pinball game having a playfield on which a ball rolls, comprising:

a) first and second ball supporting surfaces disposed above the playfield adapted to support the ball therebetween as it rolls along said first and second surfaces, wherein said second surface is a rail;

b) means for delivering a ball to said first and second surfaces;

c) a plurality of play objectives located below said first and second surfaces and spaced along the length thereof; and d) player controlled means for moving one of said first and second surfaces relative to the other to allow the ball to drop between said surfaces toward the playfield to obtain and operate one of said play objectives.

12. A pinball game having a playfield on which a ball rolls, comprising:

a) first and second ball supporting surfaces disposed above the playfield adapted to support the ball therebetween as it rolls along said first and second surfaces, wherein said first and second surfaces are rails;

b) means for delivering a ball to said first and second surfaces;

c) a plurality of play objectives located below said first and second surfaces and spaced along the length thereof; and d) player controlled means for moving one of said first and second surfaces relative to the other to allow the ball to drop between said surfaces toward the playfield to obtain and operate one of said play objectives.

13. A pinball game having a playfield on which a ball rolls, comprising:

a) first and second ball supporting surfaces disposed above the playfield and being spaced from one another a distance less than the diameter of the ball to support the ball therebetween as it rolls along said first and second surfaces;

b) means for delivering a ball to said first and second surfaces;

c) a plurality of play objectives located below said first and second surfaces and spaced along the length thereof; and d) means for moving at least one of said first and second surfaces relative to the other to space the first and second surfaces a distance greater than the diameter of the ball to allow the ball to drop between said surfaces toward the playfield to obtain and operate one of said play objectives.

14. A pinball game having a playfield on which a ball rolls, comprising:

a) first means disposed above the playfield for supporting the ball as it rolls therealong;

b) second means for delivering a ball to said first means;

c) a plurality of play objectives located below said first means and spaced along the length thereof; and d) means for dropping the ball from said first means as the ball rolls along said first means to drop the ball toward the playfield to obtain and operate one of said play objectives.

15. The pinball game according to claim 14, wherein the means for dropping is player operated.

* * * * *